US007090629B1

(12) United States Patent
Abbou

(10) Patent No.: US 7,090,629 B1
(45) Date of Patent: Aug. 15, 2006

(54) ASSISTING IN THE EXECUTION OF A SQUAT EXERCISE

(76) Inventor: Mark Abbou, 420 Highland Ave., Palisades Park, NJ (US) 07650

( * ) Notice: Subject to any disclaimer, the term of this patent is extended or adjusted under 35 U.S.C. 154(b) by 341 days.

(21) Appl. No.: 10/692,078

(22) Filed: Oct. 23, 2003

(51) Int. Cl.
*A63B 26/00* (2006.01)
*A63B 71/00* (2006.01)

(52) U.S. Cl. ..... 482/148; 482/907; 602/29

(58) Field of Classification Search ..... 482/148, 482/80, 79, 131, 139, 91, 907, 125, 104–108; 601/27–34, 5, 89–90, 97–98; 128/80 F, 128/85, 88; 602/29
See application file for complete search history.

(56) References Cited

U.S. PATENT DOCUMENTS 2,432,565 A 12/1947 Ferguson
2,580,932 A 1/1952 Lantry
3,005,662 A 10/1961 Emery
4,229,001 A * 10/1980 Roman ..... 482/79
4,432,543 A * 2/1984 Normandin ..... 482/131
4,474,176 A 10/1984 Farris et al.
4,795,142 A * 1/1989 Schaefer ..... 5/620
4,986,536 A * 1/1991 Zane ..... 482/106
5,070,863 A 12/1991 McArthur et al.
5,284,465 A 2/1994 Homan, Jr.
D359,323 S 6/1995 Ross
5,489,251 A 2/1996 Robles, Jr.
5,588,841 A 12/1996 Mechling

* cited by examiner

*Primary Examiner*—Lori Amerson
(74) *Attorney, Agent, or Firm*—Arthur Jacob

(57) ABSTRACT

Apparatus and method assist a person in the safe and proper performance of a squat exercise by precluding movement of the knees of the person in a forward direction beyond the person's toes during execution of the squat exercise. The apparatus includes two separate units for independent placement relative to one another to tailor the squat exercise to better exercise particular muscles.

19 Claims, 5 Drawing Sheets

ASSISTING IN THE EXECUTION OF A SQUAT EXERCISE

The present invention relates generally to physical fitness apparatus and procedure and pertains, more specifically, to apparatus and method for assisting in the safe and proper execution of a squat exercise.

Increasing interest in maintaining physical fitness has led more and more persons to participate in a variety of exercises designed to enhance body strength and endurance, as well as appearance. One of the more important exercises available for toning muscles of the lower body and legs is the squat exercise wherein a person's feet are placed firmly on the ground, and the knees are flexed to lower and raise the lower body relative to the stationary feet. Squat exercises, when performed properly, result in a desirable toning of lower body and leg muscles such as the glutes, the hamstrings and the quads. Women, in particular, seek to enhance their appearance through exercising these muscle groups.

However, squat exercises, if not properly performed, can lead to pain and even injury. For example, during the execution of a squat exercise, it is most important to assure that the knees are not thrust forward beyond the toes of the feet, the result of which can be deleterious angles causing undue strain and even injury to the knees.

The present invention assists in the safe and proper execution of a squat exercise in that the invention effectively precludes movement of the knees forward beyond the toes, thereby preventing deleterious angles which could cause undue strain and knee injury. As such, the present invention attains several objects and advantages, some of which are summarized as follows: Assures that the knees are maintained in an appropriate position relative to the toes during the execution of a squat exercise so as to prevent undue strain or injury; attains a maximum benefit from the performance of squat exercises, with safety and with increased ease of execution; provides relatively simple apparatus, easily employed in the performance of a safe and proper squat exercise; reduces the likelihood of developing fatigue, pain and injury while accomplishing toning of muscles of the lower body and legs through squat exercises; provides a compact, portable, easily used, relatively inexpensive and highly versatile apparatus for accomplishing the proper execution of squat exercises with a simple procedure, the apparatus having a rugged construction capable of exemplary performance over an extended service life.

The above objects and advantages, as well as further objects and advantages, are attained by the present invention which may be described briefly as apparatus for assisting a person in the performance of a squat exercise in which the person's feet are juxtaposed with a generally horizontal support surface, with the toes of each foot located forward of the heel of the foot, and the person's knees are flexed to lower and raise the person's trunk relative to the person's feet, each of the feet including toes and a heel, the apparatus comprising: a basal surface for placement relative to the generally horizontal support surface and establishing a prescribed toe position for each foot of the person's feet such that the toes of each foot are located at a corresponding prescribed toe position relative to the basal surface when the person's feet are juxtaposed with the generally horizontal support surface; a stop surface placed at a stop position elevated vertically above each toe position and juxtaposed with a stop plane extending generally vertically upwardly from the support surface and intersecting the support surface adjacent to and no farther forward than the toe position such that a knee corresponding to the foot will confront the stop surface rearward of the stop plane upon locating the toes of the foot at the corresponding toe position; and at least one support member extending between the basal surface and the stop surface to place the stop surface at the stop position so that during execution of the squat exercise, movement of the corresponding knee in a forward direction beyond the stop plane essentially will be precluded by engagement of the corresponding knee with the stop surface.

In addition, the invention provides apparatus for assisting a person in the performance of a squat exercise in which the person's feet are juxtaposed with a generally horizontal support surface, with the toes of each foot located forward of the heel of the foot, and the person's knees are flexed to lower and raise the person's trunk relative to the person's feet, each of the feet including toes and a heel, the apparatus comprising a pair of separate units, each unit including: a basal surface for placement relative to the generally horizontal support surface and establishing a prescribed toe position for one foot of the person's feet such that the toes of the one foot are located at a prescribed toe position relative to the basal surface when the person's feet are juxtaposed with the generally horizontal support surface; a stop surface placed at a stop position elevated vertically above the toe position and juxtaposed with a stop plane extending generally vertically upwardly from the support surface and intersecting the support surface adjacent to and no farther forward than the toe position such that a knee corresponding to the one foot will confront the stop surface rearward of the stop plane upon locating the toes of the one foot at the toe position; and at least one support member extending between the basal surface and the stop surface to place the stop surface at the stop position so that during execution of the squat exercise, movement of the corresponding knee in a forward direction beyond the stop plane essentially will be precluded by engagement of the corresponding knee with the stop surface.

Further, the present invention includes a method for assisting a person in the performance of a squat exercise in which the person's feet are juxtaposed with a generally horizontal support surface and the person's knees are flexed to lower and raise the person's trunk relative to the person's feet, each of the feet including toes and a heel, the method comprising: locating the toes of each foot forward of the heel of the foot and placing the foot such that the toes of the foot are located at a prescribed toe position relative to the support surface; and placing a stop surface at a stop position elevated vertically above each toe position and juxtaposed with a corresponding stop plane extending generally vertically upwardly from the support surface and intersecting the support surface adjacent to and no farther forward than a corresponding toe position such that a knee corresponding to the foot confronts the stop surface rearward of the stop plane whereby during execution of the squat exercise, movement of the corresponding knee in a forward direction beyond the corresponding stop plane essentially is precluded by engagement of the corresponding knee with the stop surface.

The present invention will be understood more fully, while still further objects and advantages will become apparent, in the following detailed description of preferred embodiments of the invention illustrated in the accompanying drawing, in which.

Figure 1:
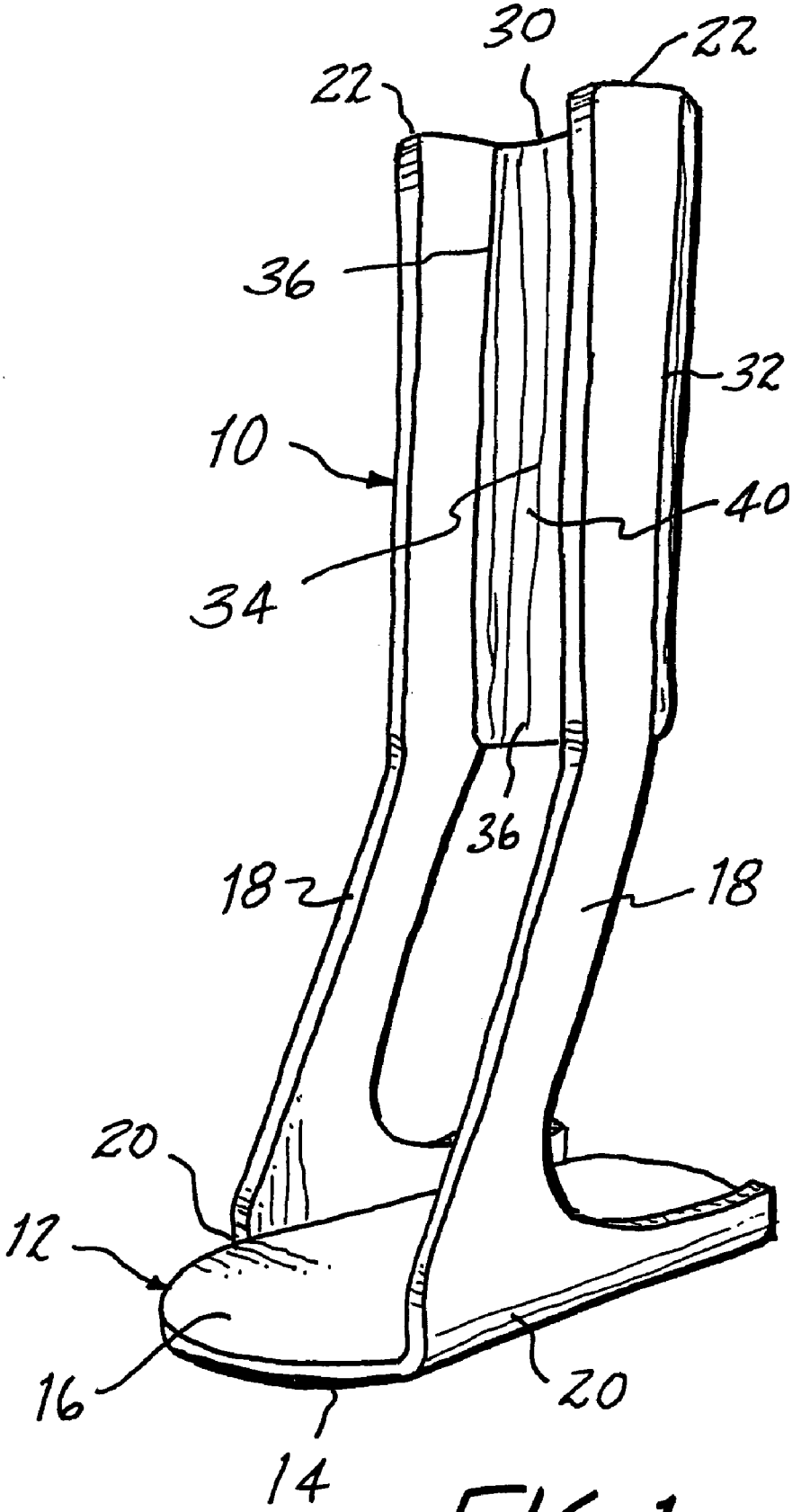
FIG. 1 is a pictorial perspective view of one unit of an apparatus constructed in accordance with the present invention.
Figure 2:
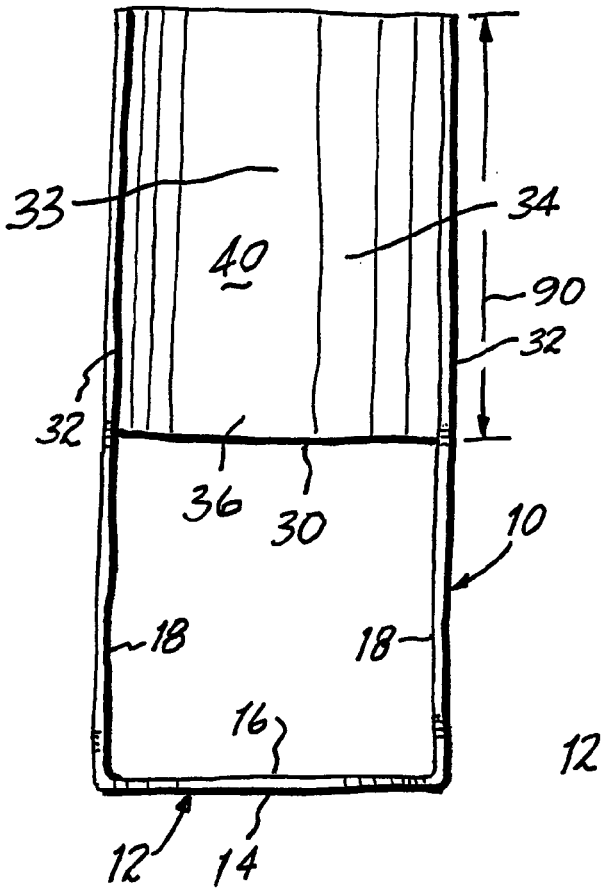
FIG. 2 is a front elevational view of the unit.
Figure 3:
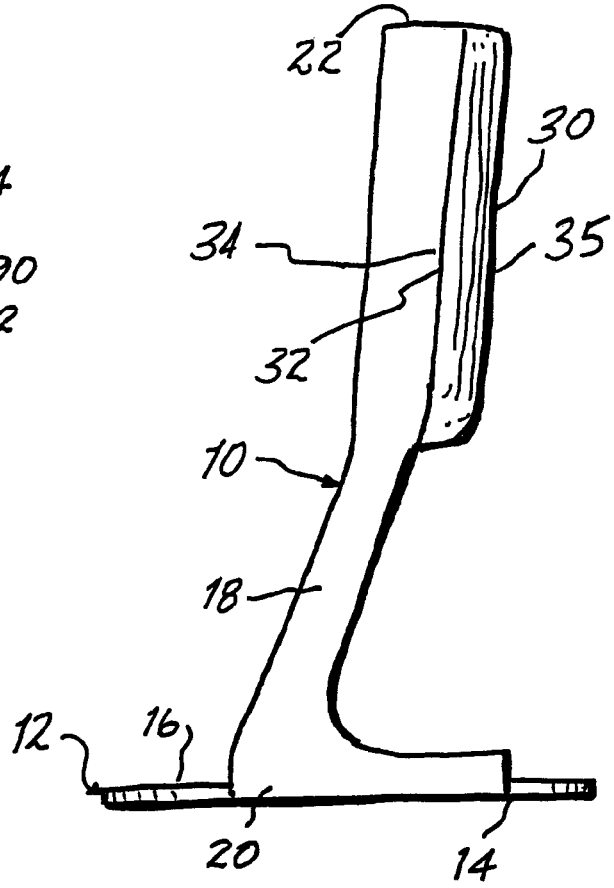
FIG. 3 is a side elevational view of the unit.
Figure 4:
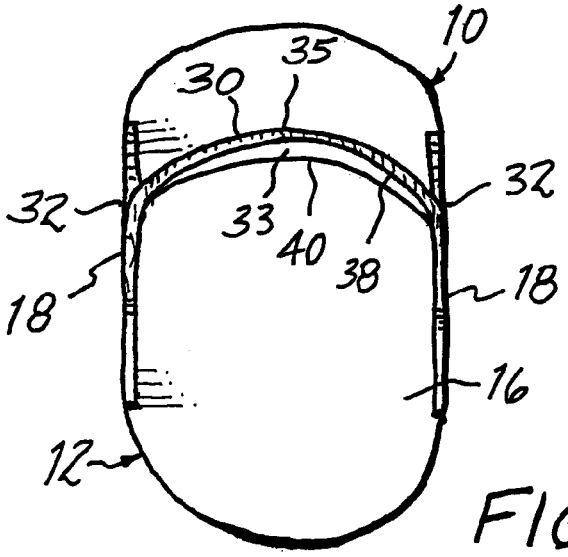
FIG. 4 is a top plan view of the unit.

Referring now to the drawing, and especially to FIGS. 1 through 4 thereof, an apparatus constructed in accordance with the present invention comprises a pair of individual units, one of which is illustrated at 10. Unit 10 includes a basal member 12 having a basal surface 14 extending along the lowermost aspect of the basal member 12, and a platform 16 juxtaposed with the basal surface 14 and placed immediately above basal surface 14, facing upwardly. Support members in the form of support columns 18 are integral with the basal member 12 at lower ends 20 of the columns 18 and extend upwardly to upper ends 22.

A stop member 30 extends laterally between the upper ends 22 of columns 18 and is integral with each column 18 at a corresponding side 32 of the stop member 30. Each column 18 has a length between ends 20 and 22 for placing the stop member 30 at a stop position 34 elevated above platform 16, and stop member 30 is curved in a forward direction and establishes a concave seat 33 at a forward central portion 35 of stop member 30, for purposes to be described below. In the illustrated preferred embodiment, basal member 12, columns 18 and stop member 30 are constructed of a relatively rigid material, such as steel, aluminum or a rigid synthetic polymeric material, and a softer, resilient protective cushion 36 is affixed at the rearward face 38 of the stop member 30, providing a stop surface 40 facing in a rearward direction.

Figure 5:
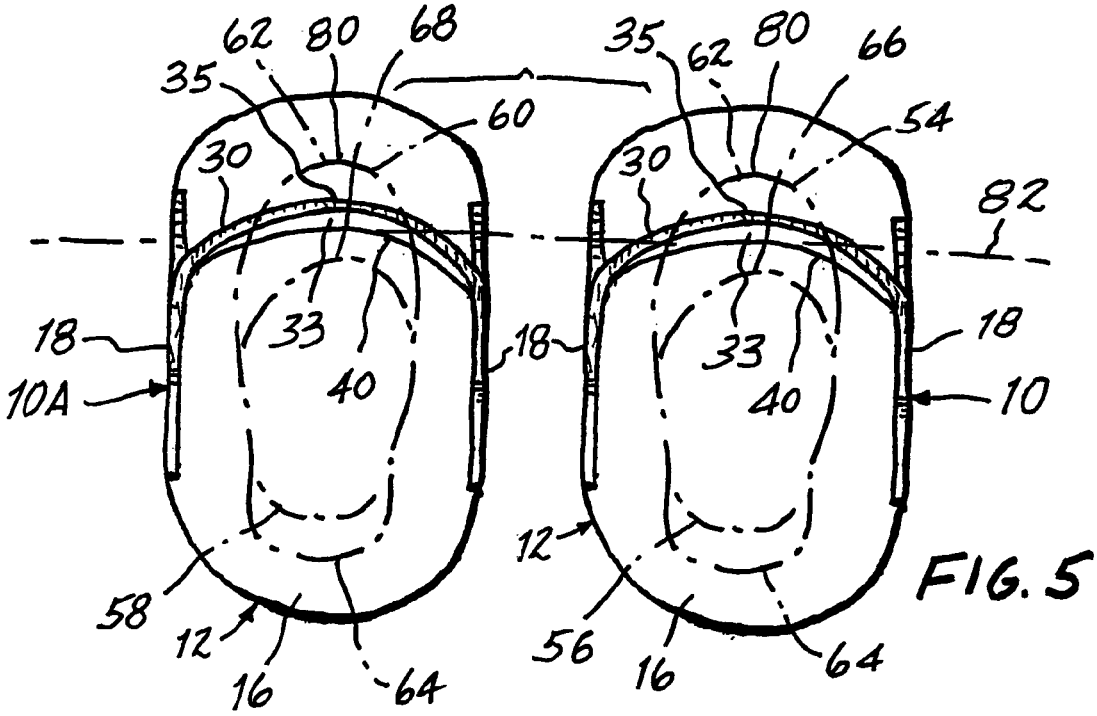
FIG. 5 is a partially diagrammatic top plan view of the apparatus showing the two units thereof and a person commencing execution of a squat exercise, with each foot placed in a unit of the apparatus.
Figure 7:
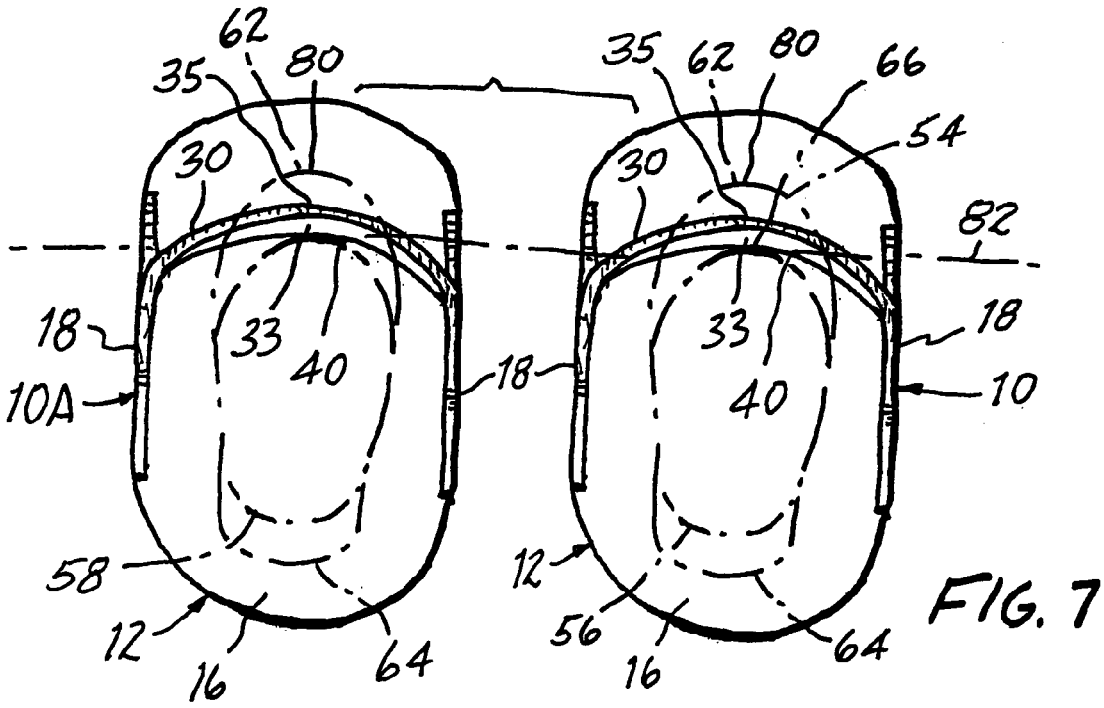
FIG. 7 is a partially diagrammatic top plan view similar to FIG. 5 and showing each foot of the person in place during execution of the squat exercise.
Figure 6:
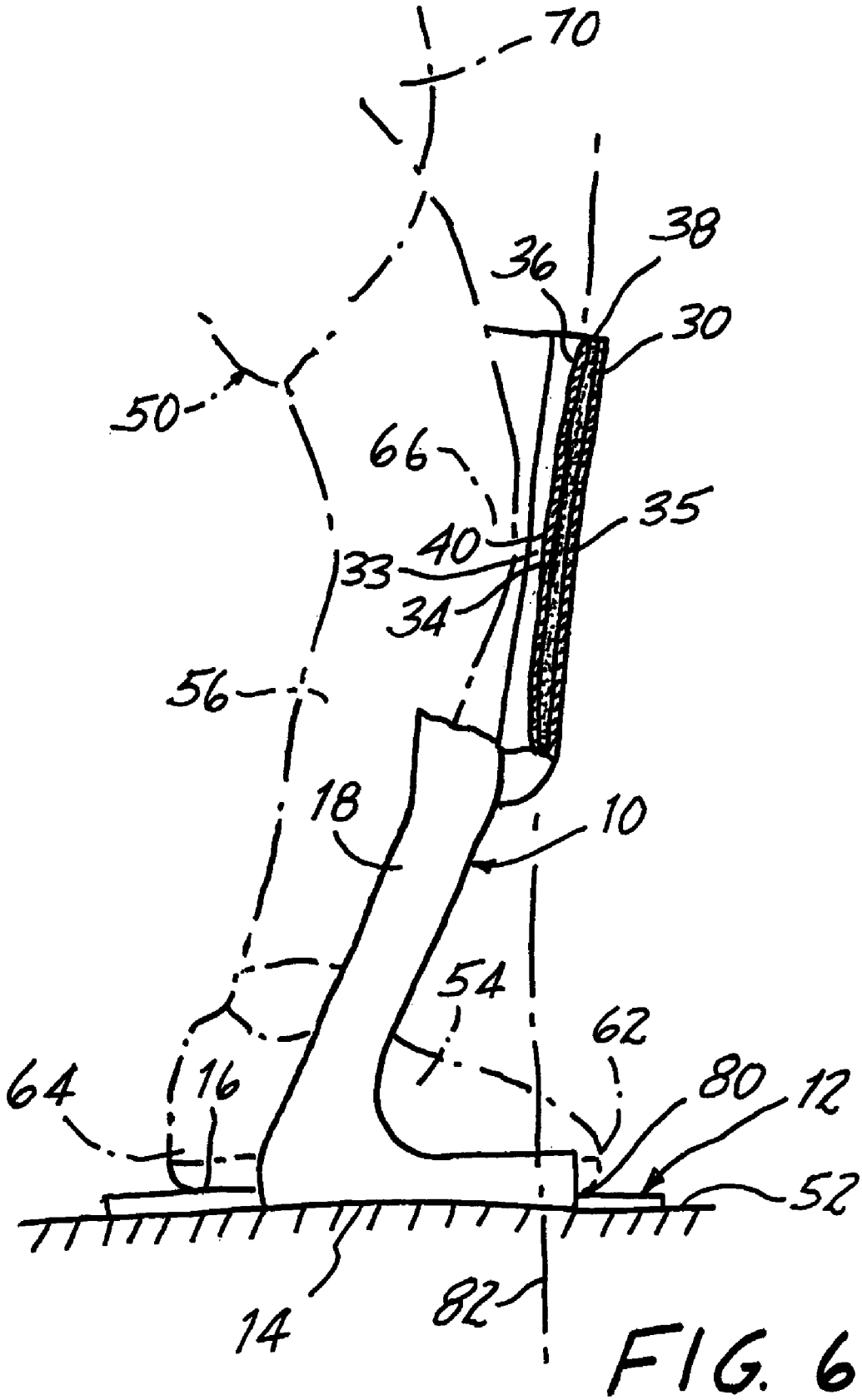
FIG. 6 is a partially diagrammatic side elevational view showing the person depicted in FIG. 5, commencing execution of a squat exercise.
Figure 8:
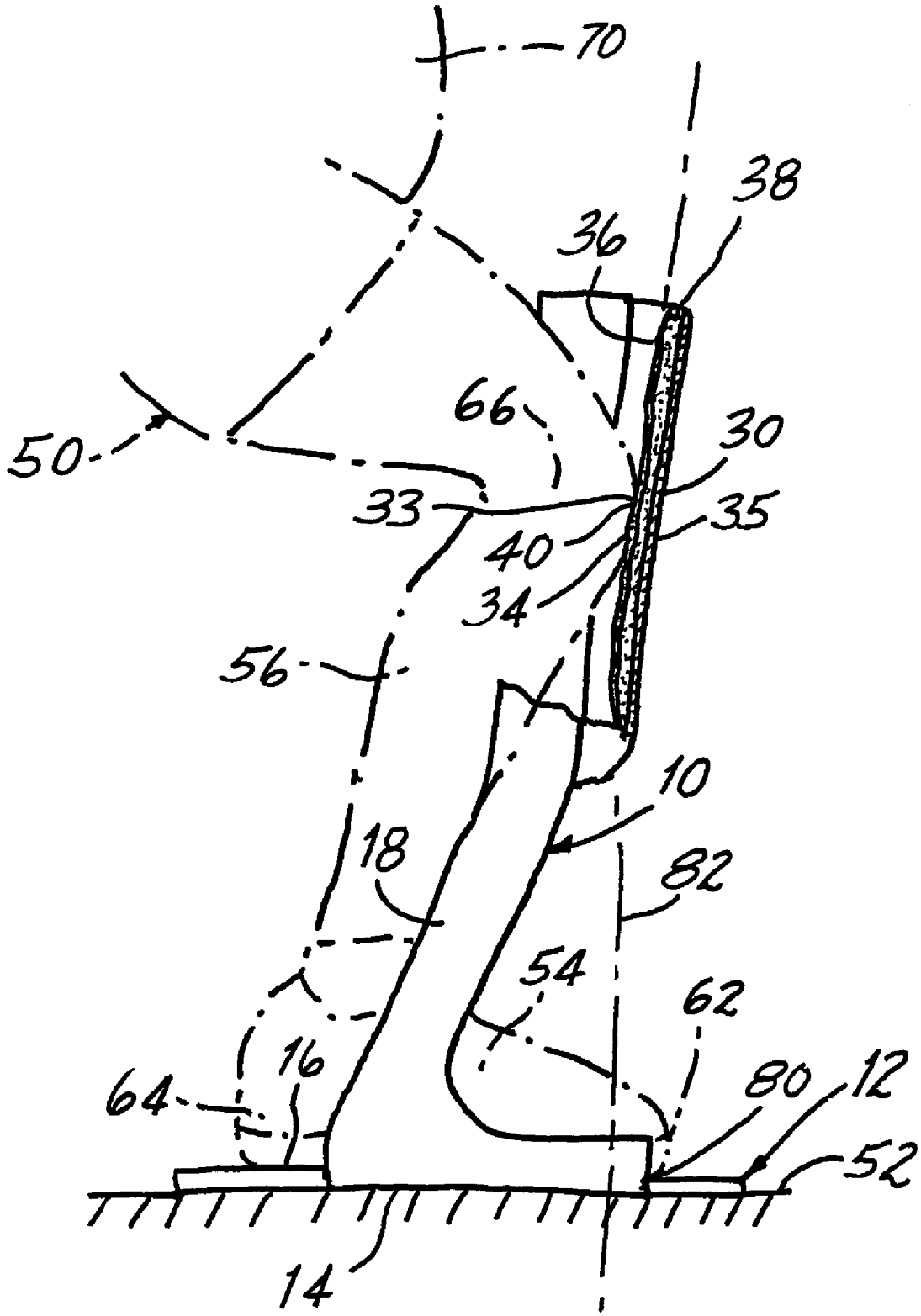
FIG. 8 is a partially diagrammatic side elevational view similar to FIG. 6 and showing the person in the position depicted in FIG. 7, during execution of the squat exercise.

Turning now to FIGS. 5 through 8, as well as to FIGS. 1 through 4, the apparatus comprises a pair of units, as indicated at 10 and 10A in FIGS. 5 and 7, both units 10 and 10A being essentially identical and constructed to assist a person 50 in attaining the safe and proper performance of a squat exercise. Basal member 12 of each unit 10 and 10A is located relative to a generally horizontal support surface, such as a floor 52, by placing basal surface 14 directly upon floor 52, with basal surface 14 extending along floor 52. The person 50 places one foot 54 on platform 16, the columns 18 being spaced apart laterally from one another a distance sufficient to admit corresponding leg 56 of the person 50 between the columns 18 when the one foot 54 is placed on platform 16, with the columns 18 extending adjacent leg 56. The other leg 58 of the person 50 extends generally parallel to the one leg 56, and the corresponding foot 60 of the other leg 58 is placed in second unit 10A in the same manner as described in connection with leg 56 and unit 10, the feet 54 and 60 being aligned generally parallel to one another, oriented along a forward direction in which the toes 62 of the feet 54 and 60 are placed forward of the heels 64.

During execution of a squat exercise, the knees 66 and 68 are flexed to lower and raise the trunk 70 of person 50, relative to feet 54 and 60. As the trunk 70 is lowered, from an upper position shown in FIGS. 5 and 6, toward a lower position shown in FIGS. 7 and 8, the knees 66 and 68 tend to be thrust forward. As described above, during the proper execution of a squat exercise, it is important to assure that the knees 66 and 68 are not thrust forward beyond the forward position of the toes 62. Units 10 and 10A limit forward movement of the knees 66 and 68 so as to assist in attaining a safe and proper execution of the squat exercise.

Thus, each foot 54 and 60 is seated firmly on a corresponding platform 16, with toes 62 placed at a prescribed toe position 80. A generally vertical stop plane 82 extends upwardly from each platform 16 and, consequently, from the floor 52, toward the corresponding stop member 30. The stop plane 82 intersects the platform 16 adjacent to and no farther forward than toe position 80, and each knee 66 and 68 confronts a corresponding stop surface 40 rearward of the stop surface 40. In the illustrated embodiment, each stop plane 82 is shown located slightly rearward of a corresponding toe position 80. Stop member 30 is supported by the columns 18 such that the stop surface 40 is placed to locate the stop position 34 in juxtaposition with the stop plane 82, with the stop plane 82 essentially intersecting the seat 33 at the central portion 35 of stop member 30. As knees 66 and 68 are flexed to lower trunk 70, any movement of each knee 66 and 68 forward beyond a corresponding stop plane 82 effectively is precluded and a safe and proper positioning of knees 66 and 68 relative to toes 62 is maintained throughout execution of the squat exercise.

To that end, columns 18 and stop member 30 are configured for providing maximum resistance to forward directed forces exerted upon stop member 30 by the engagement of each knee 66 and 68 with a corresponding stop surface 40, thus limiting forward displacement and confining movement of knees 66 and 68 to that which is desired in a safe and properly executed squat exercise. The curved configuration of stop member 30 directs each knee 66 and 68 toward a corresponding seat 33, with the central portion 35 serving to positively guide each knee 66 and 68 into a precise and accurate location provided by the concave seat 33, and each concave seat 33 then maintains a corresponding seated knee 66 or 68 at the precise, accurate location during execution of the squat exercise. In the preferred construction, protective cushion 36 is interposed between each knee 66 and 68 and a corresponding stop member 30 to provide comfort as well as protection against injury. Additionally, cushion 36 enhances the functioning of the seat 33 provided for each knee 66 and 68 at the corresponding central portion 35 of each stop member 30.

In the illustrated preferred embodiment, columns 18 are spaced apart laterally a sufficient distance to admit one leg 56 or 58, with a corresponding foot 54 or 60 seated upon platform 16. While a suitable apparatus could be constructed in the form of a single unit with a stop member wide enough to engage both knees 66 and 68 and thereby provide the desired limit to forward movement of both knees 66 and 68 in one unit, the employment of two separate, individual units 10 and 10A allows for independent placement of units 10 and 10A relative to one another, enabling greater versatility in the placement of the feet 54 and 60 relative to one another for making available variations in squat exercises better tailored to exercising the specific muscles being toned. Moreover, the construction of the apparatus in the form of the illustrated narrower separate units 10 and 10A enables simplicity, compactness, portability and economy, while increasing versatility and effectiveness in accomplishing the desired results. Compact units 10 and 10A, then, need merely be placed between corresponding feet 54 and 60 and the floor 52, anchored in place by applying the weight of the person 50 to each basal member 12 during execution of the squat exercise, for attaining exemplary performance with minimal complexity.

Complexity is reduced further in the construction of a unit 10 or 10A in that the vertical dimension 90 of stop member 30 is made great enough to accommodate any one of a number of persons having different leg lengths and concomitant different vertical positioning of their knees. Hence, while the height of stop member 30 of unit 10 or 10A could be made adjustable, through a vertically adjustable connection between the columns 18 and the stop member 30, or through the incorporation of any number of mechanisms available for enabling selection of the vertical length of the columns 18, the fixed arrangement in the construction of unit 10 or 10A renders the apparatus simple and less expensive, without sacrificing performance.

It will be seen that the present invention attains the several objects and advantages summarized above, namely: Assures that the knees are maintained in an appropriate position relative to the toes during the execution of a squat exercise so as to prevent undue strain or injury; attains a maximum benefit from the performance of squat exercises, with safety and with increased ease of execution; provides relatively simple apparatus, easily employed in the performance of a safe and proper squat exercise; reduces the likelihood of developing fatigue, pain and injury while accomplishing toning of muscles of the lower body and legs through squat exercises; provides a compact, portable, easily used, relatively inexpensive and highly versatile apparatus for accomplishing the proper execution of squat exercises with a simple procedure, the apparatus having a rugged construction capable of exemplary performance over an extended service life.

It is to be understood that the above detailed description of preferred embodiments of the invention is provided by way of example only. Various details of design, construction and procedure may be modified without departing from the true spirit and scope of the invention, as set forth in the appended claims.

The invention claimed is:

1. Apparatus for assisting a person in the performance of a squat exercise in which the person's feet are juxtaposed with a generally horizontal support surface, with the toes of each foot located forward of the heel of the foot, and the person's knees are flexed to lower and raise the person's trunk relative to the person's feet, each of the feet including toes and a heel, the apparatus comprising:

a basal surface for placement relative to the generally horizontal support surface, the basal surface being dimensioned and configured for establishing a prescribed toe position for each foot of the person's feet such that upon juxtaposition of the person's feet with the generally horizontal surface the toes of each foot will be located at a corresponding prescribed toe position relative to the basal surface;

a stop surface placed at a stop position elevated vertically above each prescribed toe position established by the dimensions and configuration of the basal surface, the stop position being juxtaposed with a stop plane extending generally vertically upwardly from the support surface and intersecting the support surface adjacent to and no farther forward than the prescribed toe position such that upon juxtaposition of the person's feet with the generally horizontal support surface, and locating the toes of a foot at the corresponding prescribed toe position, a knee corresponding to the foot will confront the stop surface rearward of the stop plane; and at least one support member extending between the basal surface and the stop surface, the at least one support member being dimensioned and configured for placing the stop surface at the stop position, the stop surface being dimensioned and configured and being located at the stop position such that upon execution of the squat exercise, movement of the corresponding knee in a forward direction beyond the stop plane essentially will be precluded by engagement of the corresponding knee with the stop surface.

2. The apparatus of claim 1 including a basal member, the basal surface being located on the basal member and being dimensioned and configured for resting upon the support surface, and a platform juxtaposed with the basal surface, the platform being dimensioned and configured for receiving the foot with the toes of the foot located at the corresponding prescribed toe position.

3. The apparatus of claim 2 wherein the platform is placed immediately above the basal surface such that upon juxtaposition of the person's feet with the generally horizontal support surface the person's weight will anchor the apparatus in place on the generally horizontal support surface during execution of the squat exercise.

4. The apparatus of claim 1 including a stop member, the stop surface being located on the stop member, the stop member being curved along a forward central portion thereof and being dimensioned and configured for establishing a concave seat juxtaposed with the stop plane for seating the corresponding knee during execution of the squat exercise.

5. The apparatus of claim 1 including a stop member, the stop surface being located on the stop member, and a protective cushion on the stop member for interposition between the stop member and the corresponding knee.

6. The apparatus of claim 1 wherein the support member comprises at least one column dimensioned and configured for extending adjacent a corresponding leg of the person to retain the stop surface at the stop position.

7. The apparatus of claim 6 wherein the support member comprises two columns spaced apart laterally from one another for accepting the corresponding leg between the two columns upon placement of the foot with the toes of the foot located at the corresponding prescribed toe position.

8. The apparatus of claim 7 including a basal member, the basal surface being located on the basal member, the basal surface being dimensioned and configured for resting upon the support surface, and a platform juxtaposed with the basal surface, the platform being dimensined and configured for receiving the foot with the toes of the foot located at the corresponding prescribed toe position.

9. The apparatus of claim 8 wherein the platform is placed immediately above the basal surface such that upon juxtaposition of the person's feet with the generally horizontal support surface the person's weight will anchor the apparatus in place on the generally horizontal support surface during execution of the squat exercise.

10. The apparatus of claim 9 including a stop member, the stop surface being located on the stop member, the stop member being curved along a forward central portion thereof and being dimensioned and configured for establishing a concave seat juxtaposed with the stop plane for seating the corresponding knee during execution of the squat exercise.

11. The apparatus of claim 10 including a protective cushion on the stop member for interposition between the stop member and the corresponding knee.

12. Apparatus for assisting a person in the performance of a squat exercise in which the person's feet are juxtaposed with a generally horizontal support surface, with the toes of each foot located forward of the heel of the foot, and the person's knees are flexed to lower and raise the person's trunk relative to the person's feet, each of the feet including toes and a heel, the apparatus comprising a pair of separate units, each unit including:

a basal surface for placement relative to the generally horizontal support surface, the basal surface being dimensioned and configured for establishing a prescribed toe position for one foot of the person's feet such that upon juxtaposition of the one foot with the generally horizontal support surface the toes of the one foot will be located at a prescribed toe position relative to the basal surface;

a stop surface placed at a stop position elevated vertically above the prescribed toe position established by the dimensions and configuration of the basal surface, the stop position being juxtaposed with a stop plane extending generally vertically upwardly from the support surface and intersecting the support surface adjacent to and no farther forward than the prescribed toe position such that upon juxtaposition of the one foot with the generally horizontal support surface and locating the toes of the one foot at the corresponding prescribed toe position a knee corresponding to the one foot will confront the stop surface rearward of the stop plane; and at least one support member extending between the basal surface and the stop surface, the at least one support member being dimensioned and configured for placing the stop surface at the stop position, the stop surface being dimensioned and configured and being located at the stop position such that upon execution of the squat exercise, movement of the corresponding knee in a forward direction beyond the stop plane essentially will be precluded by engagement of the corresponding knee with the stop surface.

13. The apparatus of claim 12 including a basal member, the basal surface being located on the basal member and being dimensioned and configured for resting upon the support surface, and a platform juxtaposed with the basal surface, the platform being dimensioned and configured for receiving the one foot with the toes of the one foot located at the prescribed toe position.

14. The apparatus of claim 13 wherein the platform is placed immediately above the basal surface such that upon juxtaposition of the one foot with the generally horizontal support surface the person's weight will anchor the apparatus in place on the generally horizontal support surface during execution of the squat exercise.

15. The apparatus of claim 12 including a stop member, the stop surface being located on the stop member, the stop member being curved along a forward central portion thereof and being dimensioned and configured for establishing a concave seat juxtaposed with the stop plane for seating the corresponding knee during execution of the squat exercise.

16. A method for assisting a person in the performance of a squat exercise in which the person's feet are juxtaposed with a generally horizontal support surface and the person's knees are flexed to lower and raise the person's trunk relative to the person's feet, each of the feet including toes and a heel, the method comprising:

locating the person's feet in juxtaposition with the generally horizontal support surface, with the toes of each foot forward of the heel of the foot, and placing the foot such that the toes of the foot are located at a prescribed toe position relative to the support surface; and placing a stop surface at a stop position elevated vertically above each prescribed toe position and juxtaposed with a corresponding stop plane extending generally vertically upwardly from the support surface and intersecting the support surface adjacent to and no farther forward than a corresponding prescribed toe position such that a knee corresponding to the foot confronts the stop surface rearward of the stop plane whereby upon execution of the squat exercise, movement of the corresponding knee in a forward direction beyond the corresponding stop plane essentially is precluded by engagement of the corresponding knee with the stop surface.

17. The method of claim 16 including anchoring the stop surface relative to the generally horizontal support surface with the weight of the person applied adjacent the prescribed toe position.

18. The method of claim 16 wherein each foot is placed such that the toes of the foot are located at a prescribed toe position in a corresponding one of separate units, and a stop surface is placed at a corresponding stop position in each separate unit, enabling selective relative positioning of the separate units for tailoring the squat exercise so as to better exercise particular selected muscles.

19. The method of claim 16 including placing a protective cushion at the stop surface for engagement by the corresponding knee during execution of the squat exercise.

* * * * *